US008171940B2

(12) United States Patent
Chuan

(10) Patent No.: US 8,171,940 B2
(45) Date of Patent: May 8, 2012

(54) ROTARY CUTTER ASSEMBLY FOR A LIGHTER

(76) Inventor: Chin-Chung Chuan, Taipei (TW)

( * ) Notice: Subject to any disclaimer, the term of this patent is extended or adjusted under 35 U.S.C. 154(b) by 389 days.

(21) Appl. No.: 12/428,472

(22) Filed: Apr. 23, 2009

(65) Prior Publication Data

US 2010/0269840 A1 Oct. 28, 2010

(51) Int. Cl.
*A24F 13/24* (2006.01)
*F23Q 2/32* (2006.01)
*A24C 1/24* (2006.01)

(52) U.S. Cl. ..... 131/249; 131/253; 131/254; 131/255; 431/253; 30/109

(58) Field of Classification Search ..... 131/249, 131/253, 255, 252; 431/253; 30/109, 111, 30/113

See application file for complete search history.

(56) References Cited

U.S. PATENT DOCUMENTS 6,298,856 B1 * 10/2001 Park ..... 131/249
6,632,082 B1 * 10/2003 Smith ..... 431/152

* cited by examiner

*Primary Examiner* — Richard Crispino
*Assistant Examiner* — Dionne Walls Mayes

(57) ABSTRACT

A rotary cutter assembly for a lighter comprises a lighter body which is defined with a receiving groove in an outer periphery thereof. A rotary plate is pivoted to the receiving groove in such a manner that the rotary plate can be rotated within the receiving groove. In the receiving groove is disposed a push pole, and on the rotary plate is provided an annular cutter. When the rotary plate is closed, the push pole is inserted in the annular cutter.

10 Claims, 14 Drawing Sheets

ROTARY CUTTER ASSEMBLY FOR A LIGHTER

BACKGROUND OF THE INVENTION

1. Field of the Invention

The present invention relates to a lighter for ignition; and more particularly to a rotary cutter assembly for a lighter, which can be opened by rotation to expose cutter for cutting holes in a cigar.

2. Description of the Prior Art

A cigar normally has both ends sealed, but before the cigar is smoked, a round hole will be cut into both ends of the cigar by a cutter. Therefore, it can be known that a lighter and a cutter are needed during cigar smoking. Conventionally, lighter and cutter are two independent members, so it is much inconvenient for the user who goes outside frequently to carry both the lighter and the cutter. In order to solve the above problem, a lighter which is provided with a cutter therein was developed on the market, and this conventional lighter is provided on a bottom thereof with an openable bottom cap through two pivot pins. In the bottom cap is disposed an annular cutter, so that when the bottom cap is opened, the annular cutter can be used to cut a round hole in both ends of the cigar. However, no support portion is provided for fixing the bottom cap after the bottom cap is opened, so it is inconvenient for the user to apply a force when cutting holes in the ends of the cigar. In addition, after the holes are cut, the wrapper of the cigar will be left within the annular cutter and need to be removed regularly, thus causing much convenience.

The present invention has arisen to mitigate and/or obviate the afore-described disadvantages.

SUMMARY OF THE INVENTION

The technical problems to be solve:

In the existing lighters provided with cutters, a bottom cap is disposed on the lighter for placement of an annular cutter, after the bottom cap is opened, since no support portion is provided for fixing the bottom cap, it is inconvenient for the user to apply a force when cutting holes in the ends of the cigar, in addition, after the holes are cut, the wrapper of the cigar will be left with in the annular cutter and need to be removed regularly, thus causing much inconvenience.

In order to solve the above technical problems, a rotary cutter assembly for a lighter in accordance with the present invention comprises a lighter body, at least one rotary plate, and at least one annular cutter. The lighter body is defined with a receiving groove in an outer periphery thereof. The receiving groove is provided with at least one pair of oppositely-arranged pivot-pin holding portions, and at least one push pole which is located a distance away from the pair of oppositely-arranged pivot-pin holding portions. The rotary plate is rotatably disposed in the receiving groove and provided on one end thereof with a pivot pin to be assembled with the pair of pivot-pin holding portions. The annular cutter is disposed on the rotary plate and provided on one end thereof with a blade portion located opposite a direction corresponding to the push pole, and a hollow portion of the annular cutter is provided for insertion of the push pole.

As compared to the conventional lighters provided with cutters, the present invention has the following advantages:

After the rotary plate is opened to expose the blade portion of the annular cutter, it is convenient to rotate the cigar on the blade portion of the annular cutter and cut rounds holes in the cigar, and after the rotary plate is closed, the push pole can push the cut wrapper of the cigar out of the hollow portion of the annular cutter, thus facilitating cleaning of the annular cutter.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
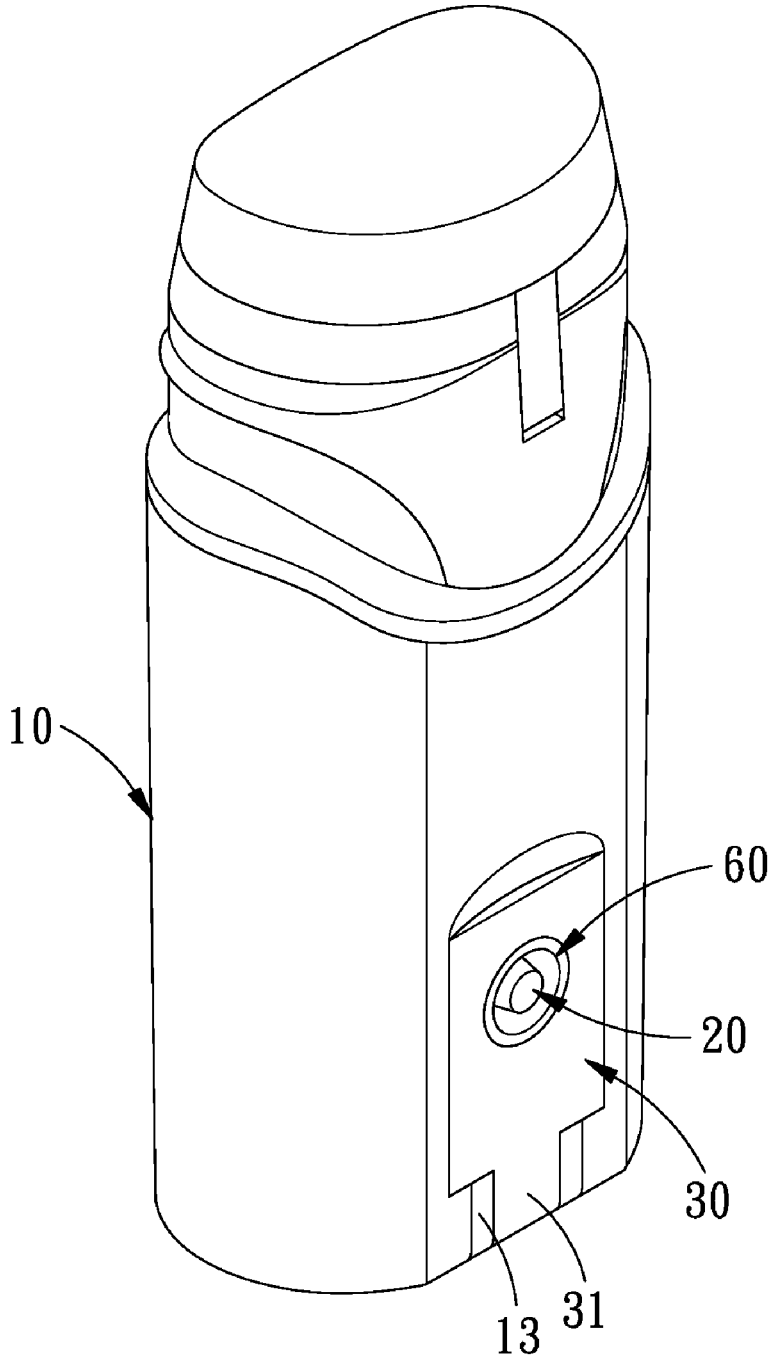
FIG. 1 is a perspective view showing a rotary cutter assembly for a lighter in accordance with a first embodiment of the present invention is closed.
Figure 2:
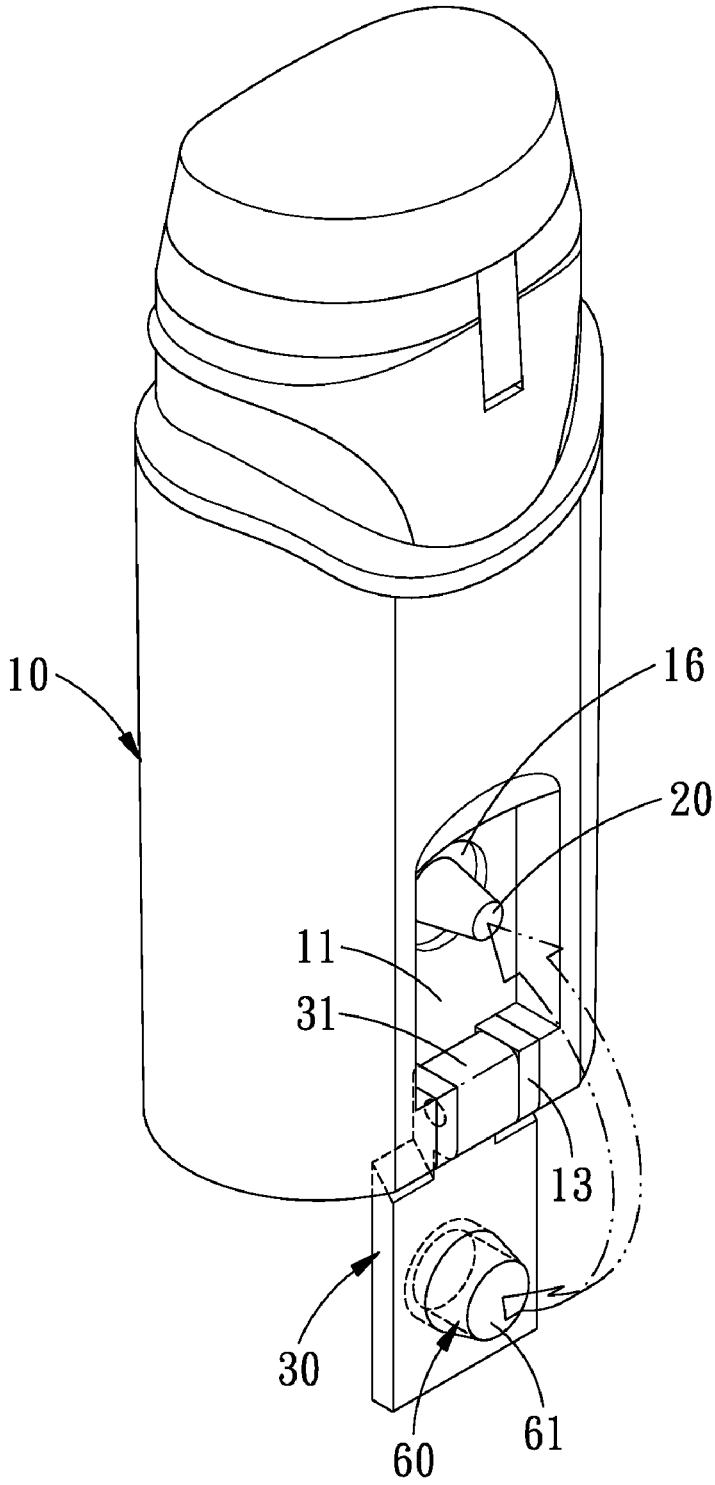
FIG. 2 is a perspective view showing the rotary cutter assembly for a lighter in accordance with the first embodiment of the present invention is opened.
Figure 3:
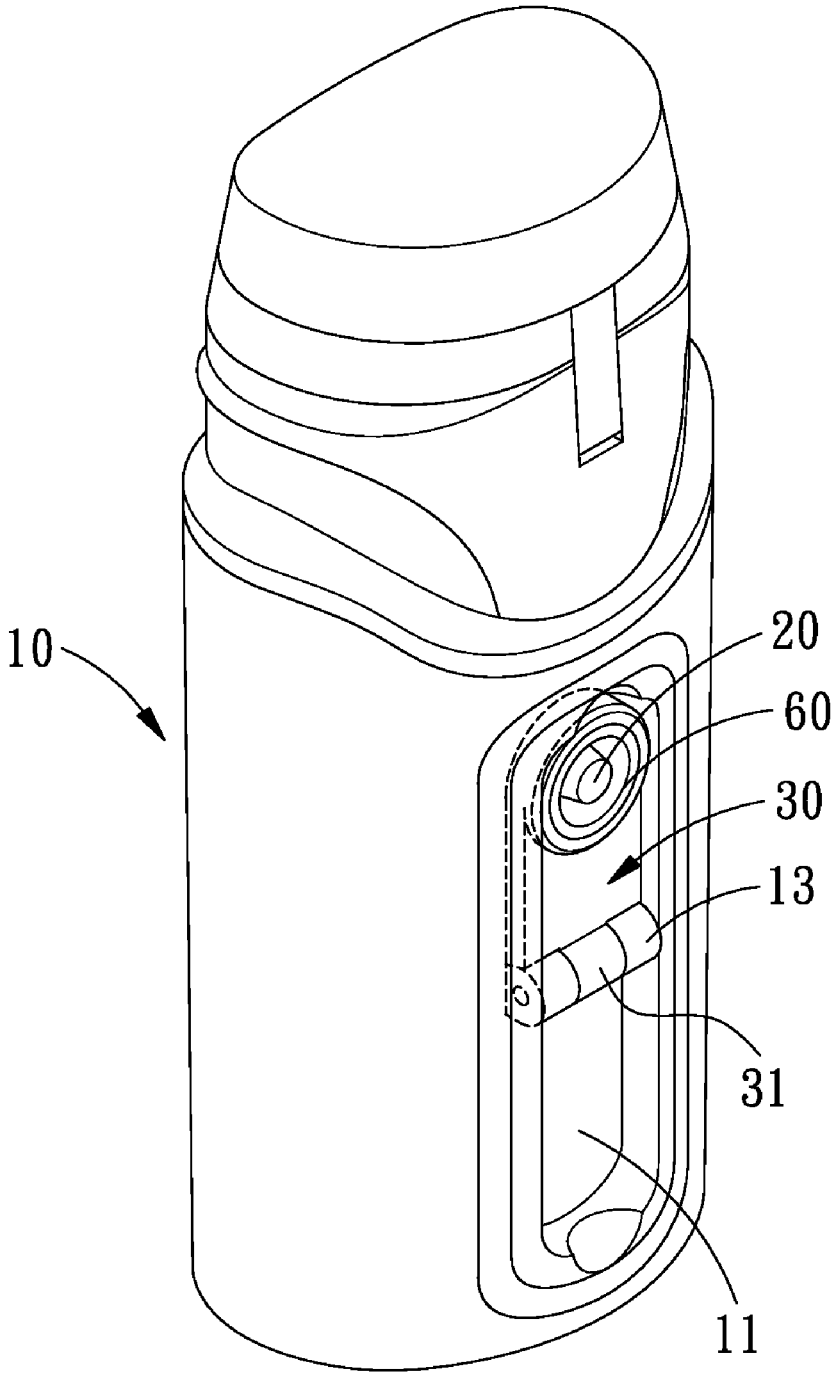
FIG. 3 is a perspective view showing a rotary cutter assembly for a lighter in accordance with a second embodiment of the present invention is closed.
Figure 4:
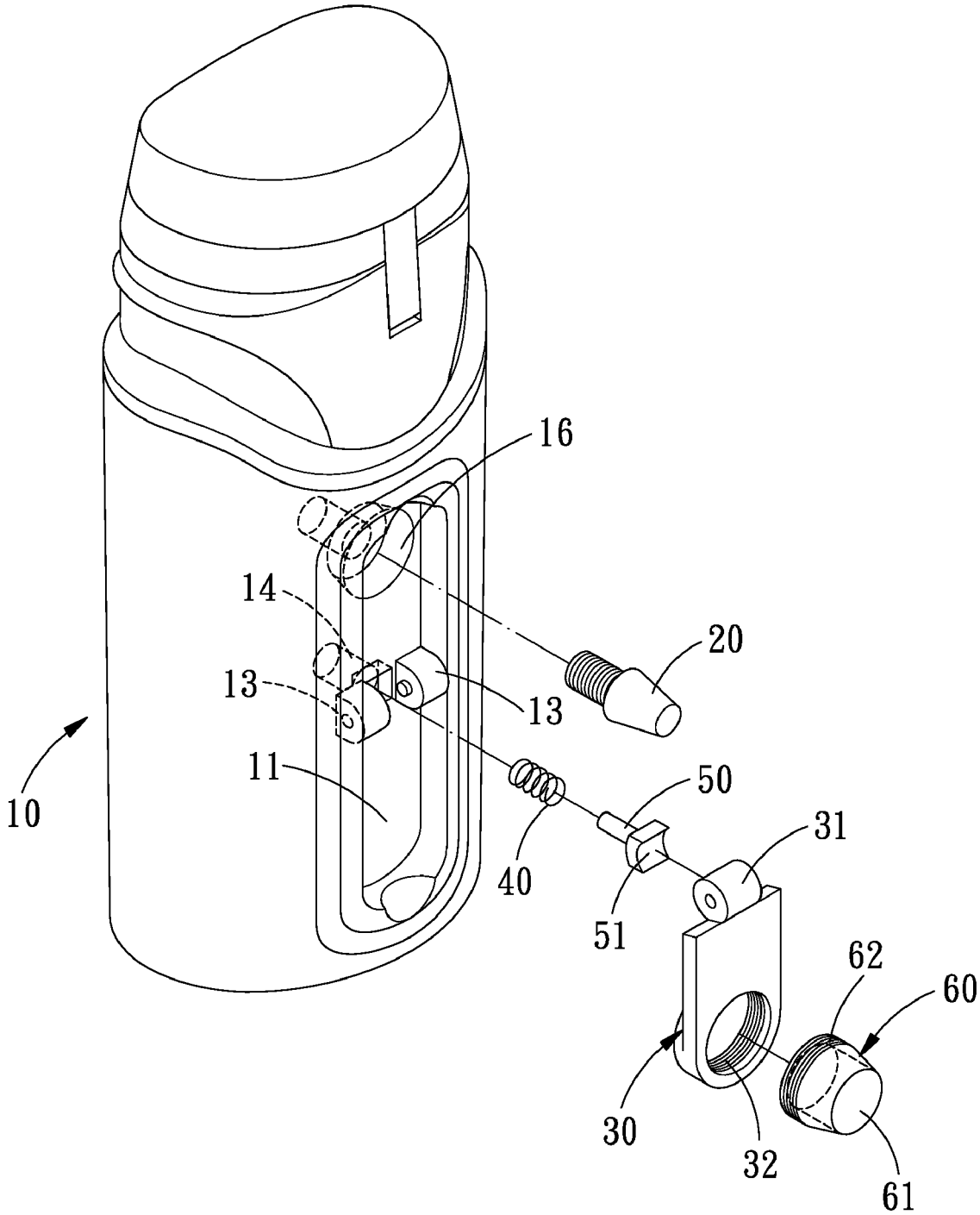
FIG. 4 is an exploded view showing the rotary cutter assembly for a lighter in accordance with the second embodiment of the present invention is opened.
Figure 9:
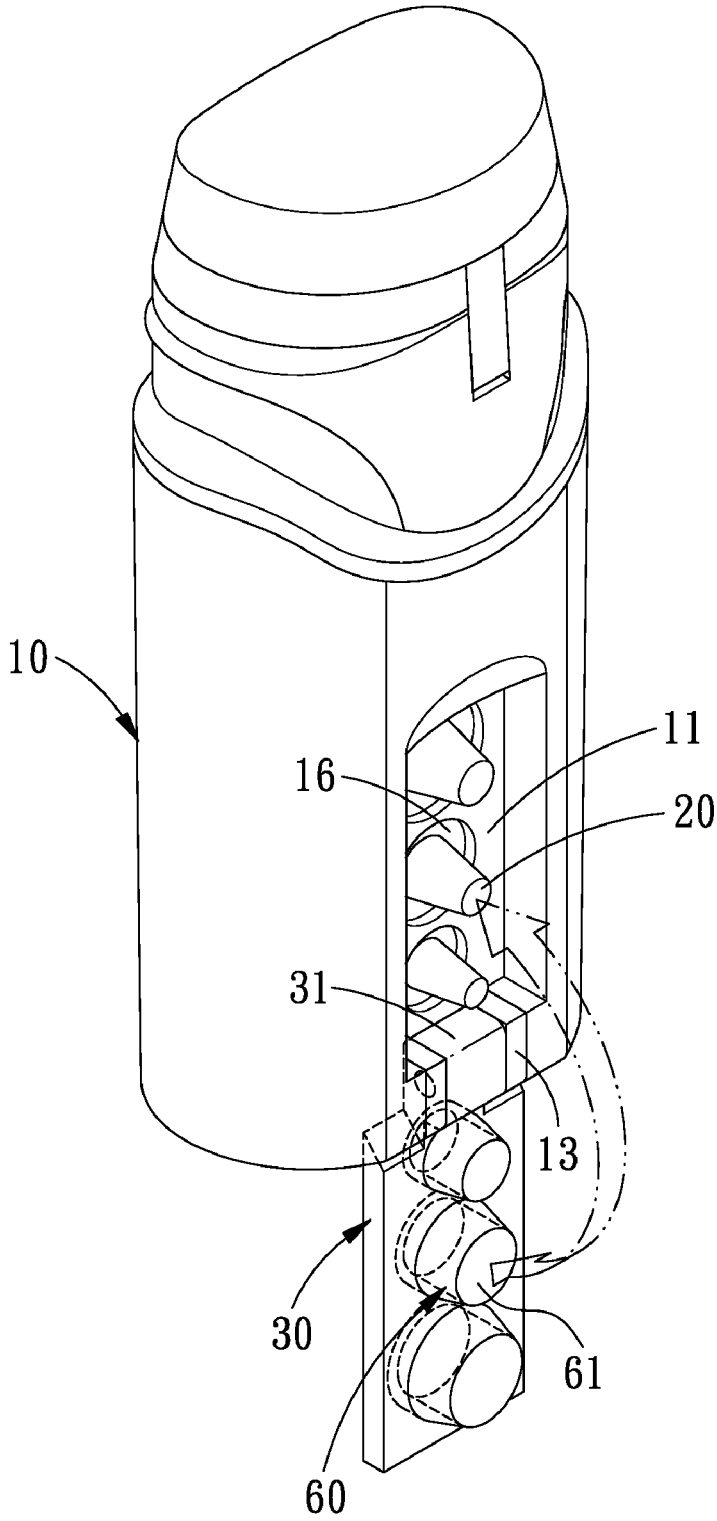
FIG. 9 is a perspective view showing a rotary cutter assembly for a lighter in accordance with a third embodiment of the present invention is opened.
Figure 10:
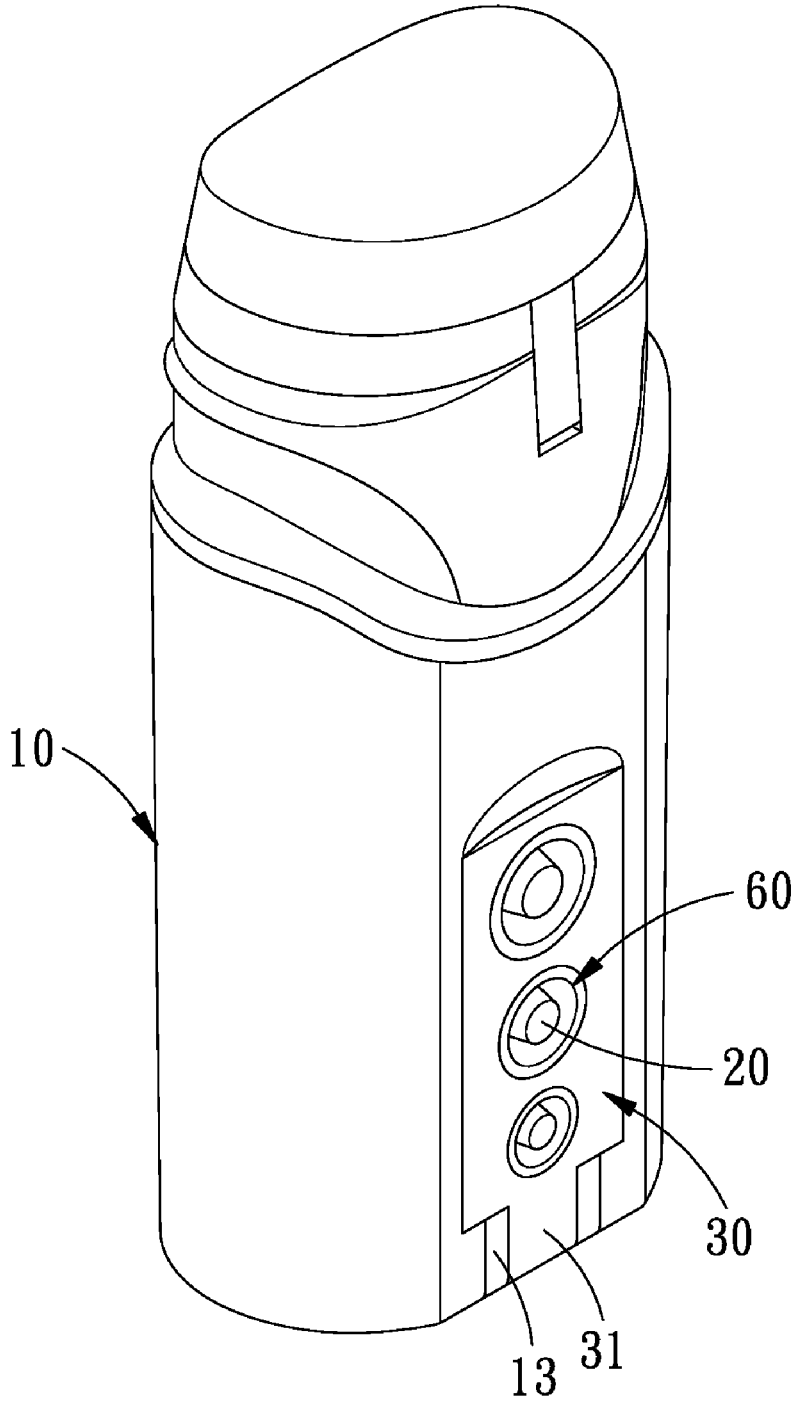
FIG. 10 is a perspective view showing a rotary cutter assembly for a lighter in accordance with the third embodiment of the present invention is closed.
Figure 11:
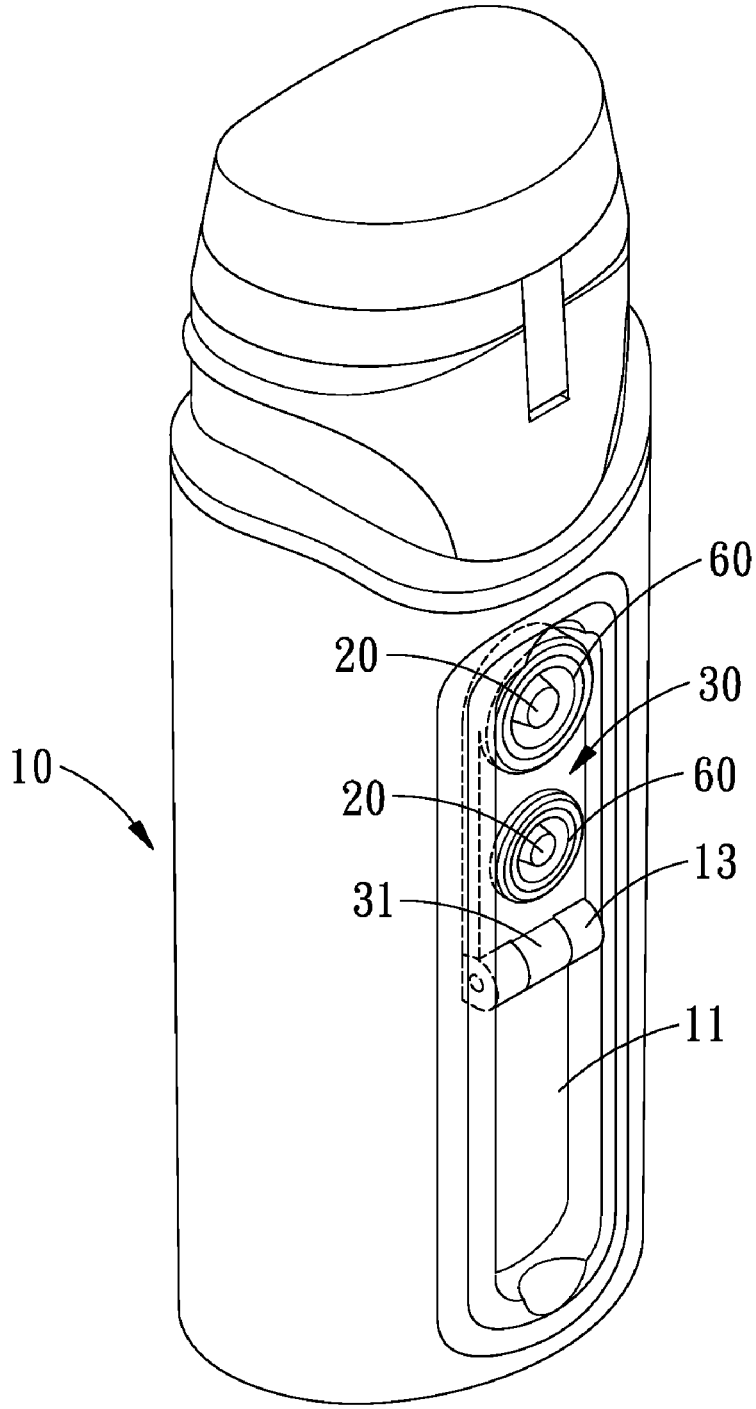
FIG. 11 is a perspective view showing a rotary cutter assembly for a lighter in accordance with a fourth embodiment of the present invention.

FIGS. 1-2 illustrate a rotary cutter assembly for a lighter in accordance with a first embodiment of the present invention. FIGS. 3-8 illustrate a rotary cutter assembly for a lighter in accordance with a second embodiment of the present invention. FIGS. 9-10 illustrate a rotary cutter assembly for a lighter in accordance with a third embodiment of the present invention. FIG. 11 illustrates a rotary cutter assembly for a lighter in accordance with a fourth embodiment of the present invention. These four embodiments in accordance with the present invention are only different in the position of the rotary plate or quantity of the cutters.

Referring to FIGS. 1-11, a rotary cutter assembly for a lighter in accordance with the present invention essentially comprises a lighter body 10, a rotary plate 30, an elastic member 40, a supporting pole 50 and at least one annular cutter 60.

The lighter body 10 is defined with a receiving groove 11 in an outer periphery thereof. The receiving groove 11 can be located in any position of a back side surface, a front side surface, a left side surface or a right side surface of the lighter body 10. In the lighter body 10 is defined with an inner gas chamber 12 for accommodation of gas. The receiving groove 11 is provided with a pair of oppositely-arranged pivot-pin holding portions 13 on a side thereof. Between the two pivot-pin holding portions 13 is defined a holding groove 14 in the bottom of the receiving groove 11. The receiving groove 11 is further provided with at least one push pole 20 which is located a distance away from the pair of pivot-pin holding portions 13, and around an outer periphery of the push pole 20 is defined an engaging groove 16.

The rotary plate 30 is rotatably disposed in the receiving groove 11. One end of the rotary plate 30 includes a pivot pin 31. The pivot-pin holding portions 13 are assembled to the pivot pin 31 in such a manner that the rotary plate 30 is allowed to pivot relative to the pivot-pin holding portions 13 to open with respect to the receiving groove 11. The rotary plate 30 is defined with at least one assembling hole 32.

The elastic member 40 is disposed in the holding groove 14.

The supporting pole 50 is disposed in the holding groove 14 and outside the elastic member 40. The supporting pole 50 is provided on an end thereof with a supporting surface 51 to elastically support against the pivot pin 31.

The annular cutter 60 is disposed on the rotary plate 30 and includes a blade portion 61 on one end thereof, and an assembling portion 62 on the other end thereof. The assembling portion 62 is assembled in the assembling hole 32. The blade portion 61 is located in a direction corresponding to the push pole 20 and allowed to be engaged into the engaging groove 16. The annular cutter 60 has a hollow portion provided for insertion of the push pole 20. If the quantity of the annular cutters 60 is more than one, these annular cutters 60 have different specifications.

Figure 5:
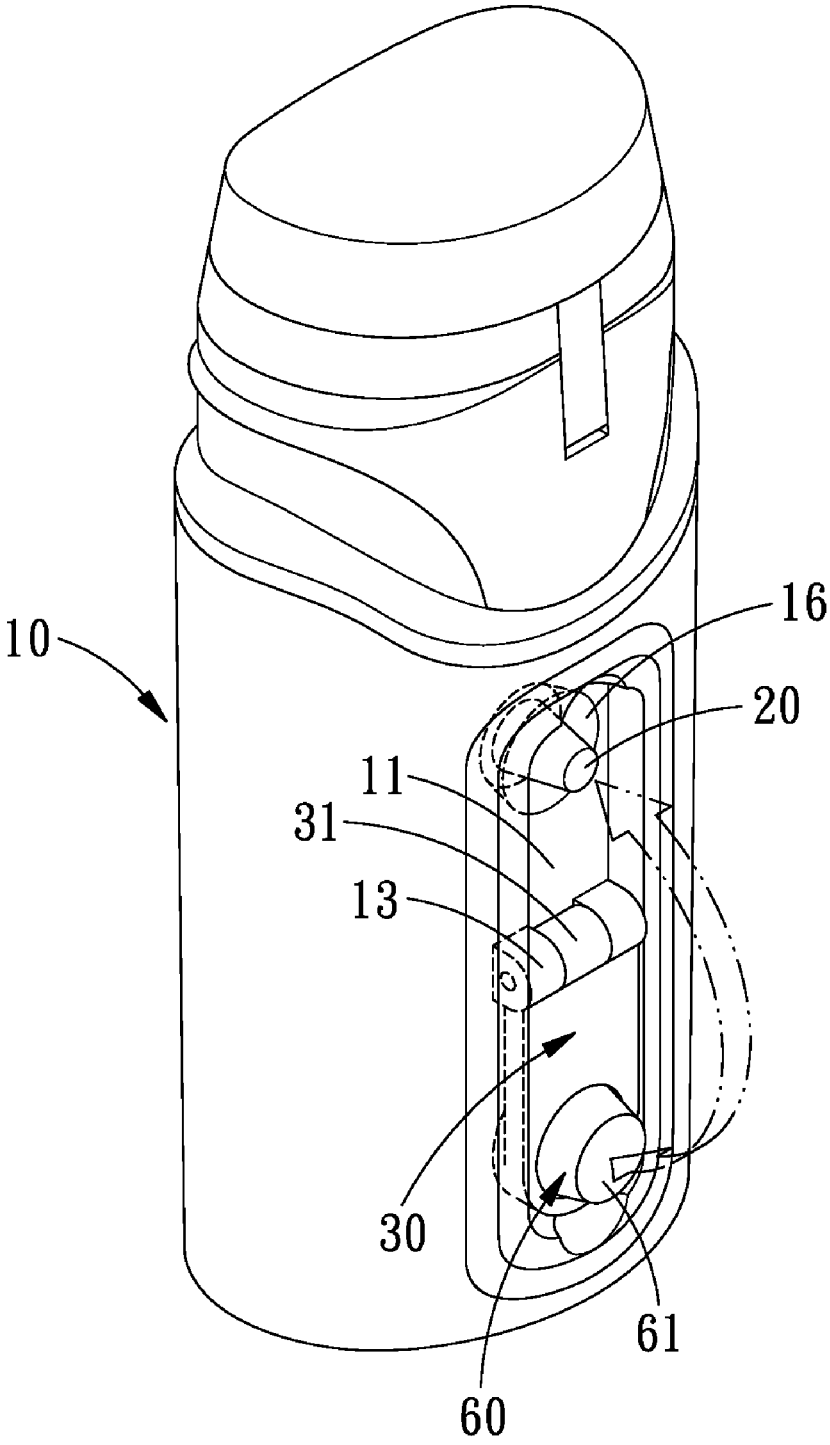
FIG. 5 is a perspective view showing the rotary cutter assembly for a lighter in accordance with the second embodiment of the present invention is opened.
Figure 6:
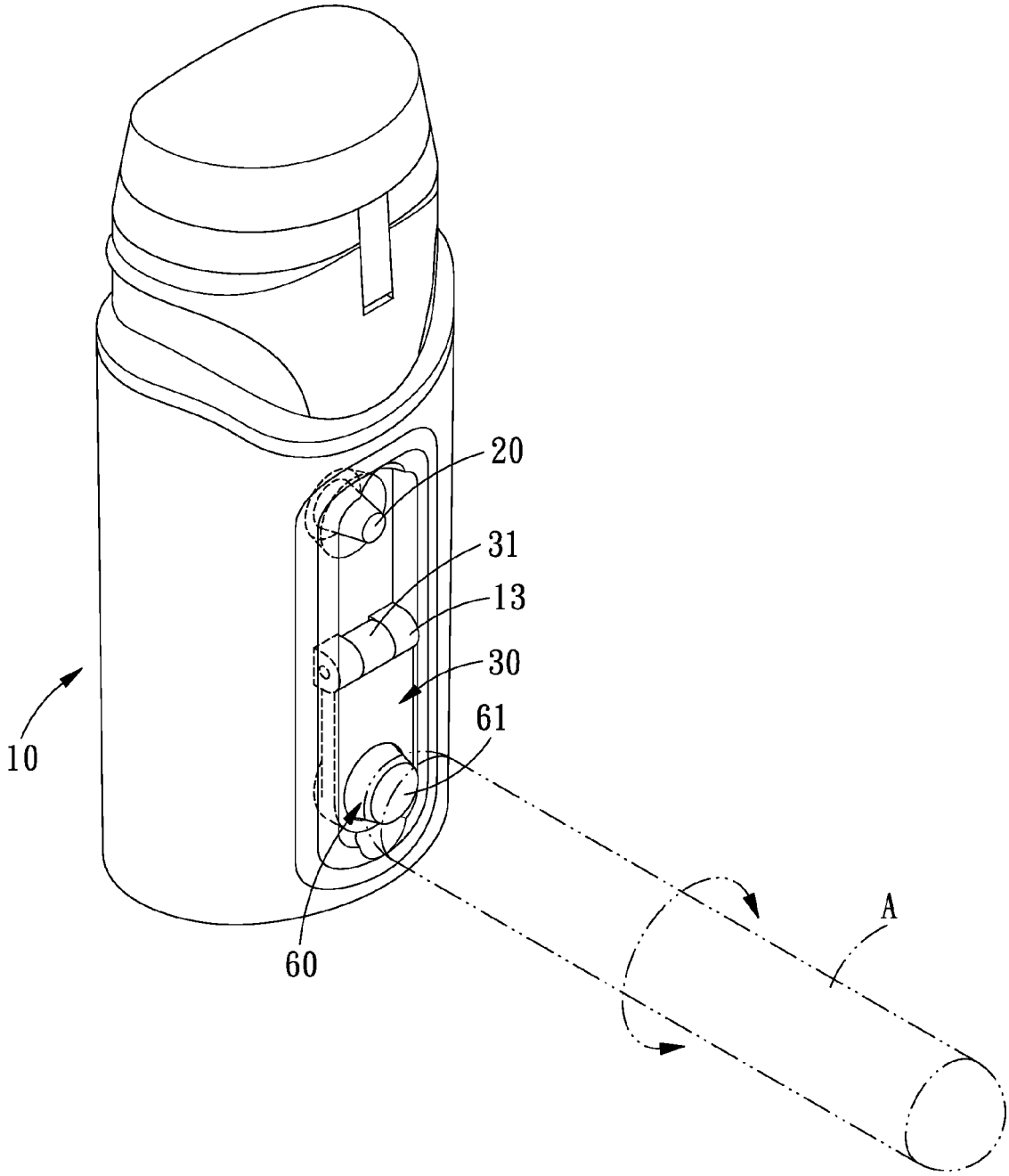
FIG. 6 is an operational view of the rotary cutter assembly for a lighter in accordance with the second embodiment of the present invention.
Figure 7:
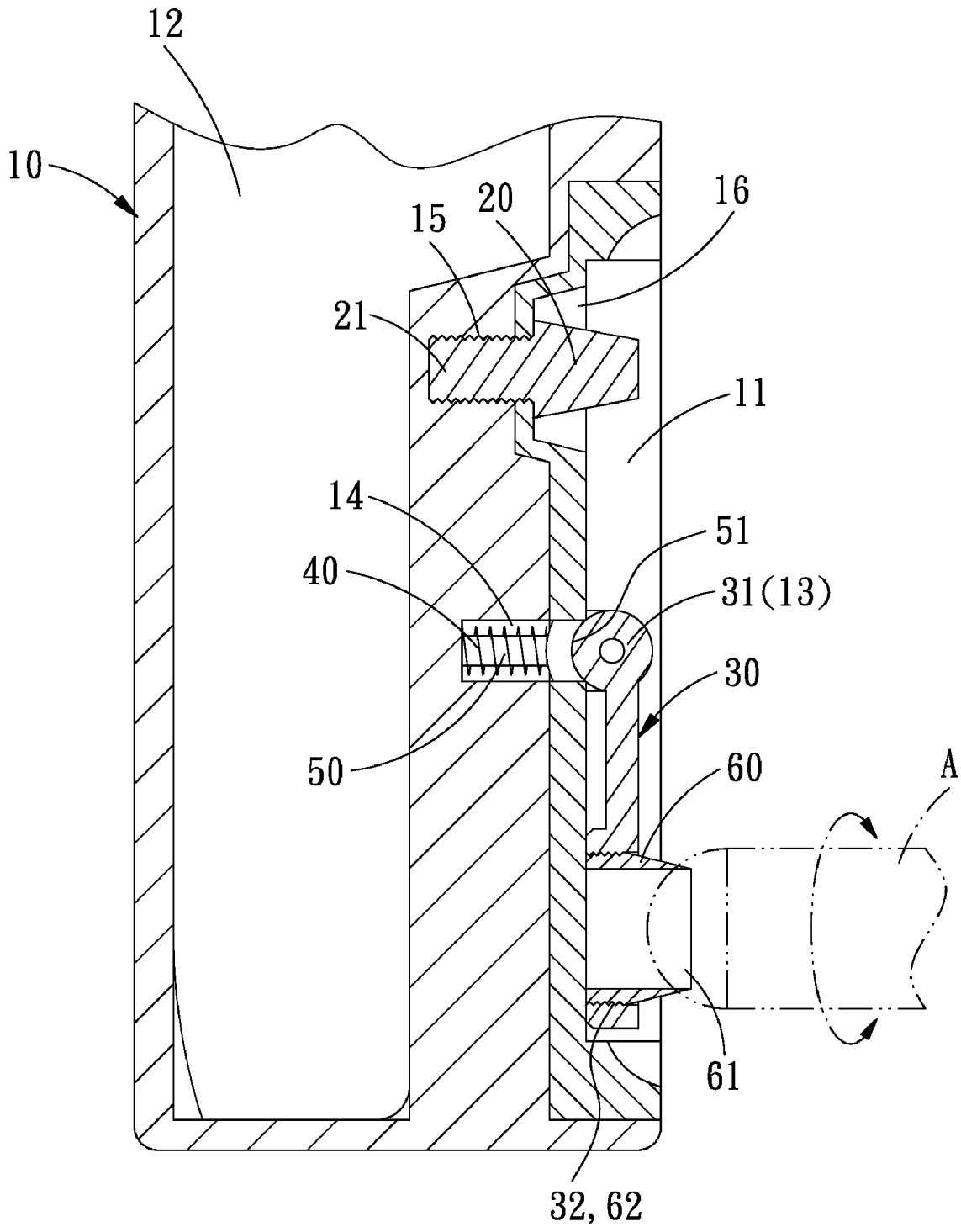
FIG. 7 is an operational cross-sectional view of the rotary cutter assembly for a lighter in accordance with the second embodiment of the present invention.

When the annular cutter 60 is not in use, as shown in FIGS. 1, 3, 10, and 11, the rotary plate 30 can be turned upward into the receiving groove 11 until the blade portion 61 on a side of the rotary plate 30 is engaged in the engaging groove 16, and the push pole 20 is inserted in hollow portion of the annular cutter 60. When the annular cutter 60 needs to be used, as shown in FIGS. 2, 5, and 9, the rotary plate 30 will be rotated downwards about the pivot-pin holding portions 13 and the pivot pin 31 until the blade portion 61 of the annular cutter 60 is exposed, as shown in FIGS. 6 and 7, so that the user can push an end of a cigar A against the blade portion 61 while rotating the cigar A to cut a round hole in the end thereof, and the cut wrapper A1 cut from the A will be left in the hollow portion of the annular cutter 60. Referring to FIG. 8 again, after the hole is cut, the rotary plate 30 can be rotated upwards to the non-use position where the blade portion 61 of the annular cutter 60 is engaged in the engaging groove 16, and the push pole 20 is inserted into the hollow portion of the annular cutter 60 to push the cut wrapper A1 out of the hollow portion of the annular cutter 60.

As shown in FIGS. 3-8, the receiving groove 11 can be two times as long as the rotary plate 30 or just as long as the rotary plate as shown in FIGS. 1-2 and 9-10. The push pole 20, the assembling hole 32 and the annular cutter 60 correspond to one another in terms of quantity, and there can be more than one annular cutter 60 for cutting different sized holes as shown in FIGS. 9-10.

If the receiving groove 11 is two times as long as the rotary plate 30, the rotary plate 30 can be opened and closed within the receiving groove 11. The pivot-pin holding portions 13 are disposed in a middle portion of the receiving groove 11 for pivotally connecting with the rotary plate 30, and the receiving groove 11 is defined with an opening in each of two opposite ends thereof for facilitating turning of the rotary plate 30, as shown in FIGS. 3, 4, 5 and 11.

If the receiving groove 11 is just as long as the rotary plate 30, the rotary plate 30 can be closed within the receiving groove 11 but opened outside the lighter body 10. The pivot-pin holding portions 13 are disposed in an open end of the receiving groove 11 for pivotally connecting with the rotary plate 30. The receiving groove 11 is defined with an opening in an end opposite the open end thereof for facilitating turning of the rotary plate 30, as show in FIGS. 1, 2, 9 and 10.

Figure 8:
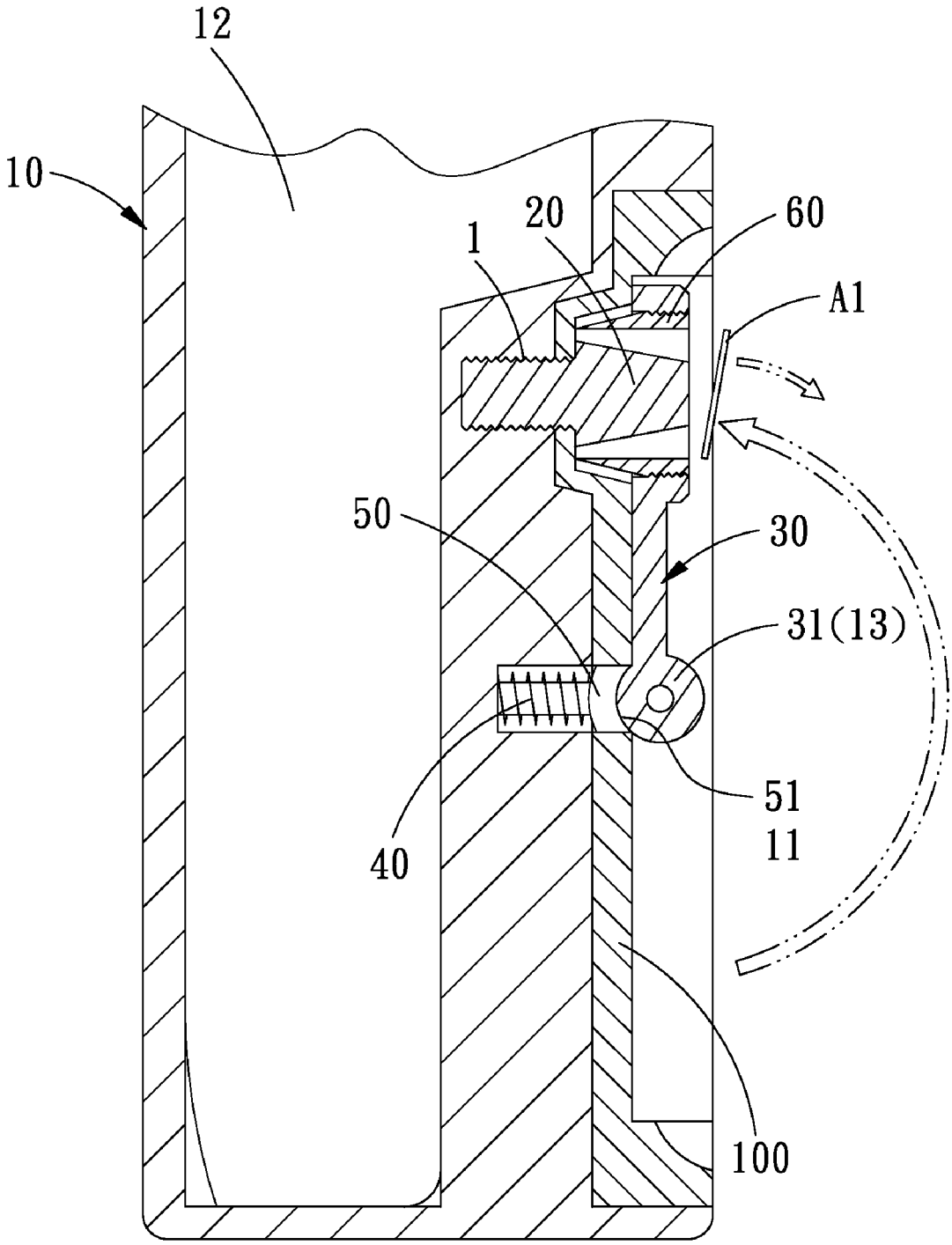
FIG. 8 is a cross-sectional view showing how the cut wrapper is pushed out by the rotary cutter assembly for a lighter in accordance with the second embodiment of the present invention.

As shown in FIGS. 7 and 8, when the rotary plate 30 is pivoted to the receiving groove 11, the pivot pin 31 of the rotary plate 30 will be subjected to an interference force applied by the supporting surface 51 of the supporting pole 50 which is pushed by an elastic force of the elastic member 40 for avoiding an undesired movement of the rotary plate 30.

Figure 12:
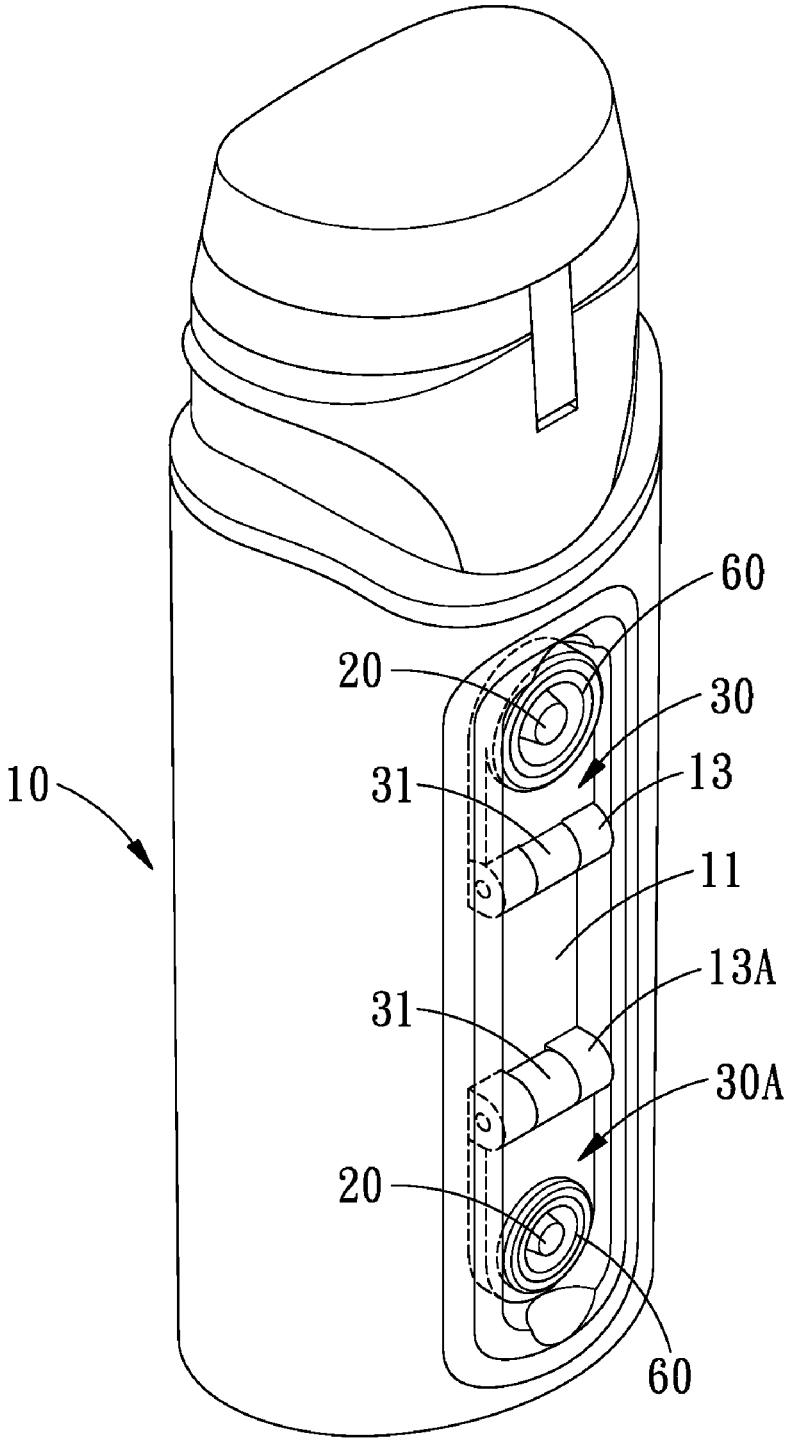
FIG. 12 is a perspective view showing that a rotary cutter assembly for a lighter in accordance with a fifth embodiment of the present invention is provided with two rotary plates.

Referring to FIG. 12, a rotary cutter assembly for a lighter in accordance with a fifth embodiment of the present invention comprises two rotary plates 30, 30A. The receiving groove 11 is three times as long as the rotary plate 30, 30A and provided with two pairs of pivot-pin holding portions 13A for pivotally connecting the two rotary plates 30, 30A, respectively. The two rotary plates 30, 30A are disposed at two opposite ends of the receiving groove 11, respectively, in such a manner that the two rotary plates 30, 30A can be opened toward the middle portion of the receiving groove 11, respectively, for selectively using different sized annular cutters 60 assembled on the two rotary plates 30, 30A.

Figure 13:
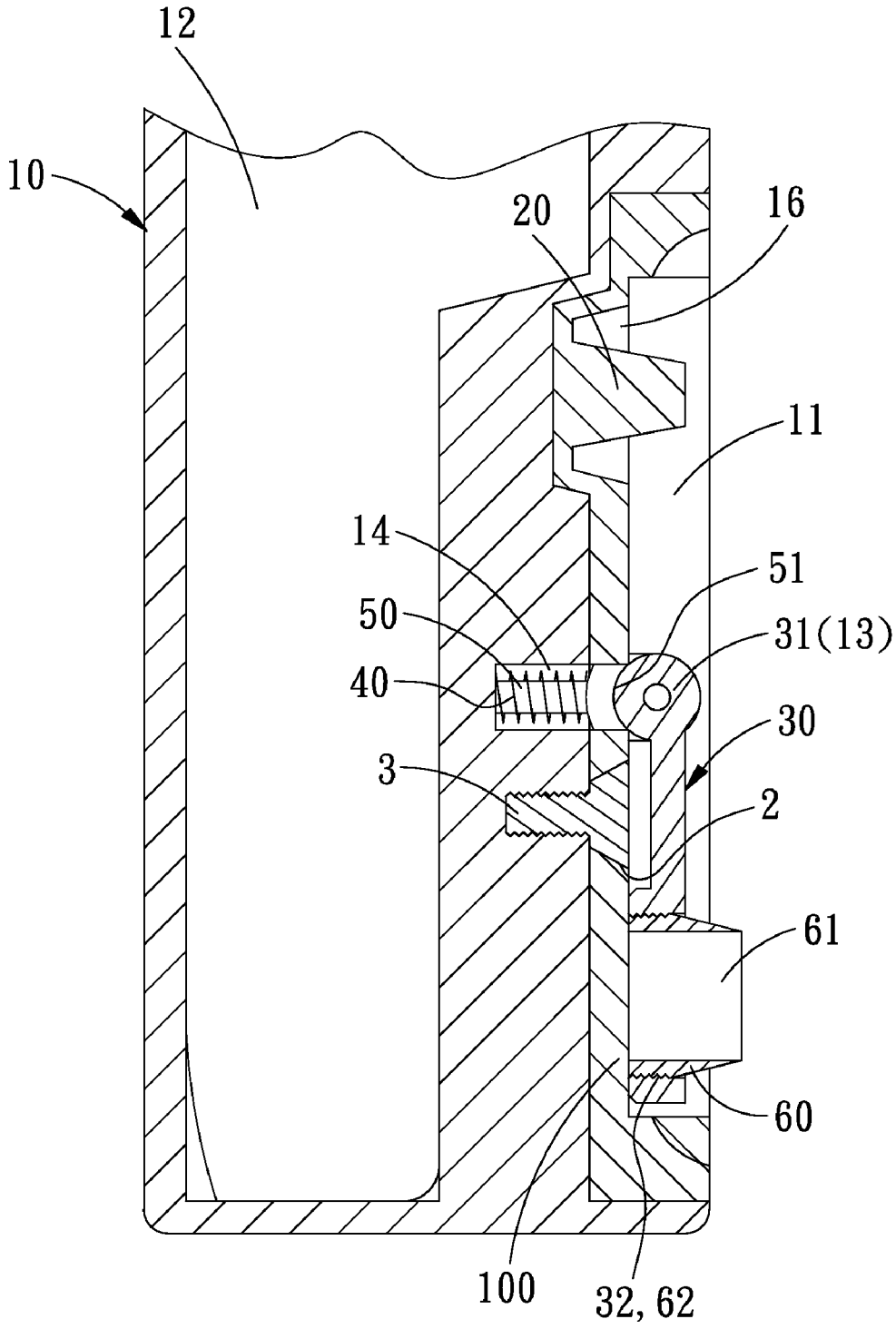
FIG. 13 is a cross-sectional view showing that a screw is screwed into the lighter body through a locking hole of a receiving base to fix the receiving base in accordance with the present invention.
Figure 14:
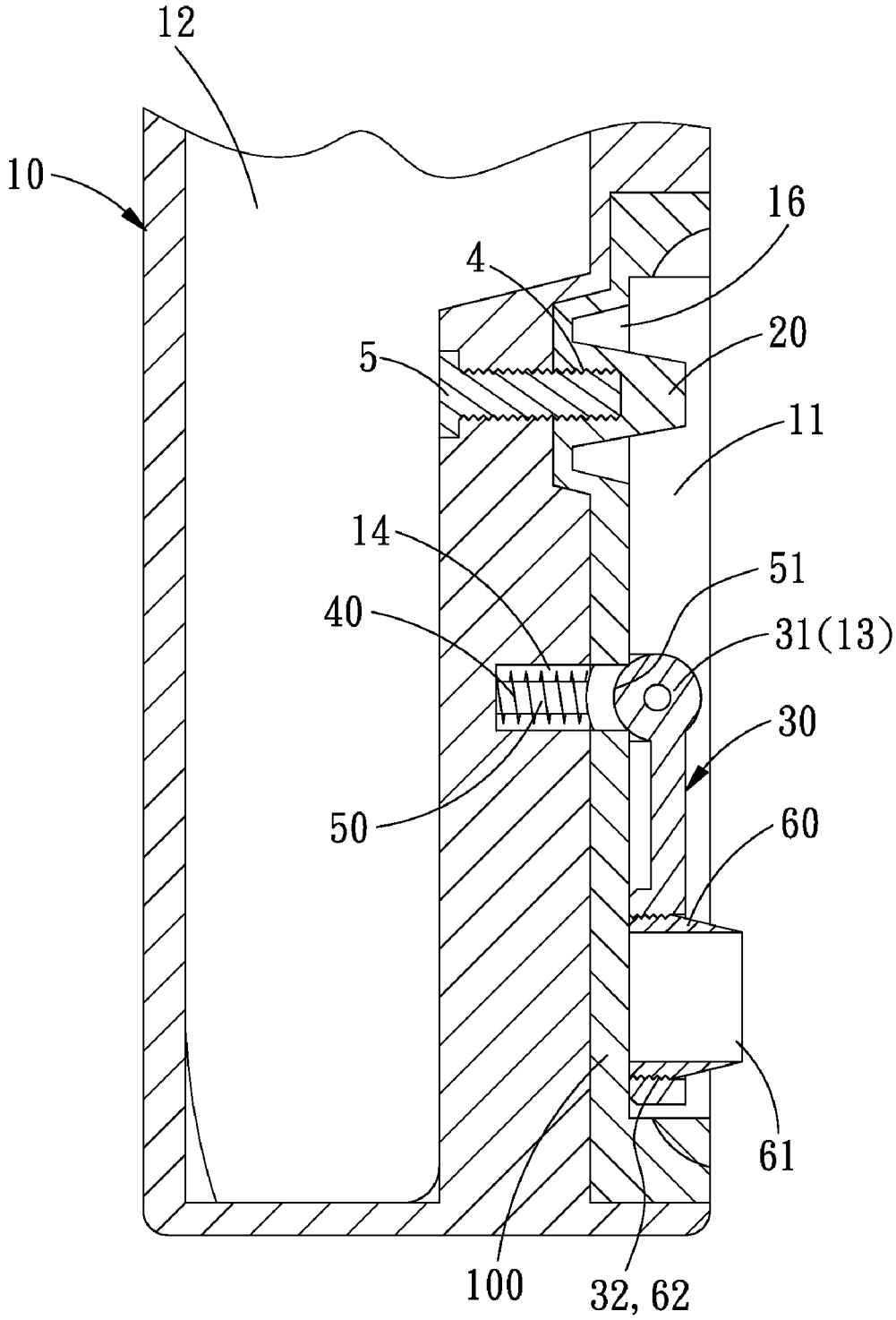
FIG. 14 is a cross-sectional view showing that a screw is screwed into a threaded hole defined in an inner side of a receiving base from a gas chamber to fix the receiving base in accordance with the present invention.

The receiving groove 11 can be directly formed in the lighter body 10 or indirectly disposed in the light body 10 in such a manner that the receiving groove 11 is first formed in a receiving base 100 and then disposed in the lighter body 10 by combining the receiving base 100 in the lighter body 10. The methods for combining the receiving base 100 in the lighter body 10 mainly include three types: the first type is as shown in FIG. 8, the push pole 20 is provided with threads 1 on a lower end thereof to be screwed into the lighter body 10 to fix the receiving base 100; the second type is as shown in FIG. 13, the receiving base 100 is defined with a locking hole 2, and a screw 3 is inserted through the locking hole 2 and then screwed into the lighter body 10 to fix the receiving base 100; and the third type is as shown in FIG. 14, the receiving base 100 is defined with a threaded hole 4 in an inner side thereof, and a screw 5 is screwed into the threaded hole 4 from the gas chamber 12 to fix the receiving base 100.

As known from the above description, the present invention has the following advantages: the rotary plate 30 is opened within the receiving groove 11, and after the blade portion 61 is exposed, it is convenient to rotate the cigar A on the blade portion 61 of the annular cutter 60 and cut a round hole in the cigar, and the cut wrapper A1 will be left in the hollow portion of the annular cutter 60, but when the rotary plate 30 is turned backwards to be closed, the cut wrapper in the hollow portion of the annular cutter 60 will be pushed out of the hollow portion of the annular cutter 60 by the push pole 20.

While we have shown and described various embodiments in accordance with the present invention, it is clear to those skilled in the art that further embodiments may be made without departing from the scope of the present invention.

What is claimed is:

1. A rotary cutter assembly for a lighter comprising:

a lighter body being defined with a receiving groove in an outer periphery thereof, and an inner gas chamber, the receiving groove being provided with at least one pair of oppositely-arranged pivot-pin holding portions on a side thereof, and at least one push pole which is located a distance away from the pair of oppositely-arranged pivot-pin holding portions;

at least one rotary plate being rotatably disposed in the receiving groove and provided on one end thereof with a pivot pin to be assembled to the pivot-pin holding portions; and at least one annular cutter being disposed on the rotary plate and provided on one end thereof with a blade portion located opposite a direction corresponding to the push pole, a hollow portion of the annular cutter being provided for insertion of the push pole;

the receiving groove is two times as long as the rotary plate, the rotary plate is operated within the receiving groove, the pivot-pin holding portions are disposed in a middle portion of the receiving groove for pivotally connecting the rotary plate.

2. The rotary cutter assembly for a lighter as claimed in claim 1, wherein the receiving groove is just as long as the rotary plate, the rotary plate is operated within the receiving groove and outside the lighter body, the pivot-pin holding portions are disposed in an open end of the receiving groove for pivotally connecting the rotary plate.

3. The rotary cutter assembly for a lighter as claimed in claim 1, wherein a holding groove is disposed between the pair of pivot-pin holding portions of the lighter body, an elastic member is disposed in the holding groove, a supporting pole is disposed in the holding groove and outside the elastic member, the supporting pole is provided with a supporting surface to support against the pivot pin of the rotary plate.

4. The rotary cutter assembly for a lighter as claimed in claim 1, wherein the receiving groove is defined with an engaging groove around an outer periphery of the push pole, the blade portion is allowed to be engaged into the engaging groove.

5. The rotary cutter assembly for a lighter as claimed in claim 1, wherein the rotary plate is defined with at least one assembling hole, the annular cutter is provided on the other end thereof with an assembling portion, the assembling portion of the annular cutter is assembled to the assembling hole of the rotary plate to fix the annular cutter on the rotary plate.

6. The rotary cutter assembly for a lighter as claimed in claim 1 comprising two rotary plates and two annular cutters, the two annular cutters being respectively assembled on the two rotary plates, the receiving groove being provided with two push poles corresponding to the two annular cutters, the receiving groove being three times as long as the rotary plate and provided with two pairs of oppositely-arranged pivot-pin holding portions for pivotally connecting the two rotary plates, the two rotary plates being disposed at two opposite ends of the receiving groove.

7. The rotary cutter assembly for a lighter as claimed in claim 1, wherein the receiving groove is disposed in the lighter body in such a manner that the receiving groove is formed in a receiving base which is fixed in the lighter body.

8. The rotary cutter assembly for a lighter as claimed in claim 7, wherein the push pole is formed on a lower end thereof with threads to be screwed into the lighter body to fix the receiving base.

9. The rotary cutter assembly for a lighter as claimed in claim 7, wherein the receiving base is defined with a locking hole, a screw is screwed into the lighter body through the locking hole of the receiving base from the receiving groove to fix the receiving base.

10. The rotary cutter assembly for a lighter as claimed in claim 8, wherein the receiving base is defined with a threaded hole in an inner side thereof, a screw is screwed into the threaded hole of the receiving base from the gas chamber to fix the receiving base.

* * * * *